US006207777B1

(12) United States Patent
Shimada et al.

(10) Patent No.: US 6,207,777 B1
(45) Date of Patent: Mar. 27, 2001

(54) ANTIFOULING COMPOSITION, METHOD FOR ITS PRODUCTION AND PRODUCT TREATED THEREWITH

(75) Inventors: Toyomichi Shimada; Akane Sanekata; Takashige Maekawa, all of Yokohama (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/106,347

(22) Filed: Jun. 29, 1998

(30) Foreign Application Priority Data

Jun. 30, 1997 (JP) ..... 9-174728
Jan. 30, 1998 (JP) ..... 10-019760
Mar. 31, 1998 (JP) ..... 10-087047

(51) Int. Cl.[7] ..... C08F 18/20; C08F 20/22
(52) U.S. Cl. ..... 526/245; 526/246; 526/301
(58) Field of Search ..... 526/245, 246, 526/301

(56) References Cited

U.S. PATENT DOCUMENTS 4,834,764 * 5/1989 Deiner et al. ..... 8/115.64
4,859,754 8/1989 Maekawa et al. .
5,057,577 * 10/1991 Matsuo et al. ..... 525/276
5,068,295 * 11/1991 Misaizu et al. ..... 526/245
5,081,165 * 1/1992 Inukai et al. ..... 526/245
5,100,954 3/1992 Itoh et al. .
5,258,458 * 11/1993 Allewaert et al. ..... 525/104
5,372,731 * 12/1994 Michels et al. ..... 252/8.62
5,466,770 11/1995 Audenaert et al. .
5,508,370 * 4/1996 Reiff et al. ..... 528/45
5,626,950 * 5/1997 Shimano et al. ..... 442/76
5,688,309 11/1997 Shimada et al. .
5,753,568 * 5/1998 Shimano et al. ..... 442/64
5,817,249 * 10/1998 Audenaert et al. .

FOREIGN PATENT DOCUMENTS 0 617 061 9/1994 (EP) .
2 277 840 2/1976 (FR) .
WO 92/17636 10/1992 (WO) .
WO 93/01349 1/1993 (WO) .
WO 96/12775 5/1996 (WO) .

OTHER PUBLICATIONS

Derwent Abstracts, AN 91–061048, JP 03 008873, Jan. 16, 1991.

* cited by examiner

*Primary Examiner*—Terrel Morris
*Assistant Examiner*—Arti Singh
(74) *Attorney, Agent, or Firm*—Oblon, Spivak, McClelland, Maier & Neustadt, P.C.

(57) ABSTRACT

An antifouling composition comprising, as an effective component, a copolymer comprising the following polymer units (a), (b), (c) and (d):

(a) polymer units of a (meth)acrylate having a polyfluoroalkyl group, (b) polymer units of a (meth)acrylate having a polyoxyethylene group, (c) polymer units of a (meth)acrylate having a polyoxypropylene group, and (d) polymer units of a (meth)acrylate having a blocked isocyanate group.

14 Claims, No Drawings

ANTIFOULING COMPOSITION, METHOD FOR ITS PRODUCTION AND PRODUCT TREATED THEREWITH

The present invention relates to an antifouling composition excellent in durability of the antifouling property and color fastness.

It has been common to apply a composition having a fluorine moiety and a hydrophilic moiety to clothings which are susceptible to fouling, such as working wears. Such treatment is intended to impart water and oil repellency to fibers and to impart a nature (hereinafter referred to as an antifouling property) whereby deposition of soil is prevented or any soil attached may readily be removed by washing. The following substances are known as an effective component of the composition used for such treatment. (In this specification, "$R^f$" group" means a polyfluoroalkyl group, and "(meth)acrylate" means acrylate and/or methacrylate, and the same applies to a representation such as "(meth) acrylamide".)

(1) A copolymer of a polymerizable compound having a $R^f$ group, a (meth)acrylate having a polyoxyethylene group and acrylonitrile (JP-A-50-20991).

(2) A compound obtained by reacting an isocyanate compound having at least two functional groups, a compound having both a $R^f$ group and an isocyanate reactive group, a compound having both an epoxy group and an isocyanate reactive group, and a compound having both a hydrophilic group and an isocyanate reactive group (JP-A-61-23674).

(3) A copolymer of a (meth)acrylate having a $R^f$ group, a polyalkylene glycol (meth)acrylate, a (meth)acrylate having a hydroxyl group, and an alkyl (meth)acrylate or butadiene (JP-A-3-103411).

(4) A copolymer of a (meth)acrylate having a $R^f$ group, a (meth)acrylate having a polyoxyalkylene group, and a (meth)acrylate having an epoxy group (JP-A-4-68006).

(5) A copolymer of a (meth)acrylate having a $R^f$ group, a (meth)acrylate having a polyoxyalkylene group, 3-chloro-2-hydroxypropyl (meth)acrylate and glycerol mono(meth) acrylate (JP-A-6-116340).

(6) A copolymer of a (meth)acrylate having a $R^f$ group, a (meth)acrylate having a polyoxyalkylene group, and a (meth)acrylate having a blocked isocyanate group (JP-A-6-279687).

The conventional compositions all had a drawback such that the antifouling properties of the treated fibers tended to decrease by washing. To prevent such a decrease of the antifouling properties, a method has been proposed to use these compositions in combination with a melamine resin or a compound having a blocked isocyanate group at the time of treatment of the fibers. However, in such a case, the cloth is likely to undergo yellowing, or its texture tends to be hard. Further, the copolymer as an effective component, contains a large amount of hydrophilic moieties, whereby there has been a drawback that the color fastness is poor, and application of such a method is difficult particularly to e.g. deep colored fiber materials.

It is an object of the present invention to provide an antifouling composition which is capable of imparting a durable antifouling property without a problem such as yellowing of the cloth or hardening of the texture and which provides excellent color fastness.

The present inventors have found that a product treated with an antifouling composition comprising a certain specific copolymer, has excellent durability with respect to the antifouling property and at the same time, exhibits excellent color fastness.

Namely, the present invention provides an antifouling composition comprising, as an effective component, a copolymer comprising the following polymer units (a), (b), (c) and (d):

(a) polymer units of a (meth)acrylate having a polyfluoroalkyl group, (b) polymer units of a (meth)acrylate having a polyoxyethylene group, (c) polymer units of a (meth)acrylate having a polyoxypropylene group, and (d) polymer units of a (meth)acrylate having a blocked isocyanate group.

Now, the present invention will be described in detail with reference to the preferred embodiments.

The polymer units (a) are polymer units of a (meth) acrylate having a $R^f$ group. The (meth)acrylate having a $R^f$ group is meant for a compound having a $R^f$ group at an alcohol residue of the (meth)acrylate.

The $R^f$ group is meant for a group having at least two hydrogen atoms of an alkyl group substituted by fluorine atoms. The carbon number of the $R^f$ group is preferably from 2 to 20, particularly preferably from 6 to 16. Further, as the $R^f$ group, a linear or branched group is preferred. In the case of a branched group, it is preferred that the branched moiety is present at a terminal portion of the $R^f$ group, and it is a short chain having a carbon number of from about 1 to 4. The $R^f$ group may contain halogen atoms other than fluorine atoms. As such other halogen atoms, chlorine atoms are preferred. Further, a carbon atom in the $R^f$ group may be substituted by an etheric oxygen atom.

The number of fluorine atoms in the $R^f$ group is preferably at least 60%, more preferably at least 80%, as represented by [(the number of fluorine atoms in the $R^f$ group)/(the number of hydrogen atoms contained in an alkyl group having the same carbon number as the $R^f$ group)]×100 (%). Further, the $R^f$ group is preferably a group having all of hydrogen atoms of an alkyl group substituted by fluorine atoms (i.e. a perfluoroalkyl group), or a group having a perfluoroalkyl group at its terminal portion.

The carbon number of the perfluoroalkyl group is preferably from 2 to 20, more preferably from 6 to 16. If the carbon number is less than 6, the water repellency and oil repellency of the antifouling composition tend to decrease. On the other hand, if it exceeds 16, the copolymer tends to be solid at room temperature, and tends to readily sublime, whereby its handling tends to be difficult.

The (meth)acrylate having a $R^f$ group is preferably a compound represented by the following formula 1. In the formula 1, $R^f$ represents a $R^f$ group, Q represents a bivalent organic group, and R is a hydrogen atom or a methyl group. As the $R^f$ group, those disclosed in the following specific examples and Examples are preferred.

$$R^f\text{—Q—OCOCR=CH}_2 \quad (1)$$

Q may, for example, be $—(CH_2)_{p+q}—$, an alkylene group having a branch, $—(CH_2)_pCONH(CH_2)_q—$, $—(CH_2)_pNHCO(CH_2)_q—$, $—(CH_2)_pOCONH(CH_2)_q—$, $—(CH_2)_pNHOCO(CH_2)_q—$, $—(CH_2)_pSO_2NR'(CH_2)_q—$, $—(CH_2)_pNR'SO_2(CH_2)_q—$, $—(CH_2)_pNHCONH(CH_2)_q—$, or $—(CH_2)_pCH(OH)(CH_2)_q—$, wherein R' is a hydrogen atom or an alkyl group, and each of p and q is an integer of at least 0, provided that p+q is an integer of from 1 to 22.

It is preferred that Q is $—(CH_2)_{p+q}—$, $—(CH_2)_pCONH(CH_2)_q—$ or $—(CH_2)_pSO_2NR'(CH_2)_q—$, wherein q is an integer of at least 2, and p+q is from 2 to 6. Particularly preferred is $—(CH_2)_{p+q}—$, wherein p+q is from 2 to 6, i.e.

from an ethylene group to a hexamethylene group. It is preferred that fluorine atoms are bonded to the carbon atom of $R_f$ bonded to Q.

The alkylene group having a branch may, for example, be preferably —$CH_2CH(CH_3)$—, —$CH(CH_3)CH_2$—, —$CH_2CH(CH_3)CH_2$—, —$CH_2CH_2CH(CH_3)$—, —$CH(CH_3)CH_2CH_2$—, —$CH_2CH_2CH(CH_3CH_2$—, or —$CH_2CH(CH_3)CH_2CH_2$—, particularly preferably —$CH_2CH_2CH(CH_3)$—.

Specific examples of the (meth)acrylate having a $R_f$ group will be given below. In these examples, R represents a hydrogen atom or a methyl group.

$F(CF_2)_5CH_2OCOCR{=}CH_2$.
$F(CF_2)_6CH_2CH_2OCOCR{=}CH_2$.
$H(CF_2)_6CH_2CH_2OCOCR{=}CH_2$.
$F(CF_2)_8CH_2CH_2OCOCR{=}CH_2$.
$(CF_3)_2CF(CF_2)_5CH_2CH_2OCOCR{=}CH_2$.
$F(CF_2)_8SO_2N(C_3H_7)CH_2CH_2OCOCR{=}CH_2$.
$F(CF_2)_8CH_2CH_2CH_2OCOCR{=}CH_2$.
$F(CF_2)_8(CH_2)_4OCOCR{=}CH_2$.
$F(CF_2)_8CH_2CH_2CH(CH_3)OCOCR{=}CH_2$.
$F(CF_2)_8SO_2N(CH_3)CH_2CH_2OCOCR{=}CH_2$.
$F(CF_2)_8SO_2N(C_2H_5)CH_2CH_2OCOCR{=}CH_2$.
$F(CF_2)_8CONHCH_2CH_2OCOCR{=}CH_2$.
$(CF_3)_2CF(CF_2)_5(CH_2)_3OCOCR{=}CH_2$.
$(CF_3)_2CF(CF_2)_5CH_2CH(OCOCH_3)$—$OCOCR{=}CH_2$.
$(CF_3)_2CF(CF_2)_5CH_2CH(OH)CH_2OCOCR{=}CH_2$.
$F(CF_2)_9CH_2CH_2OCOCR{=}CH_2$.
$F(CF_2)_9CONHCH_2CH_2OCOCR{=}CH_2$.

The copolymer of the present invention may contain one type or more than one types of polymer units (a). When more than one types of polymer units (a) are contained, they are preferably a mixture of (meth)acrylates having $R^f$ groups with different carbon numbers.

The polymer units (b) are polymer units of a (meth) acrylate having a polyoxyethylene group. This (meth) acrylate is a compound having a polyoxyethylene group at the alcohol residue of the (meth)acrylate, and the polyoxyethylene group may contain a small amount of other oxyalkylenes, so long as it maintains the hydrophilic nature.

As such a (meth)acrylate, a compound of the following formula 2 is preferred. In the formula 2, $R^1$ is a hydrogen atom or a $C_{1-30}$ hydrocarbon group. $Q^1$ is a single bond or a bivalent organic group. R is a hydrogen atom or a methyl group, and m is an integer of from 1 to 100, preferably an integer of from 3 to 30.

$$R^1—Q^1—(OCH_2CH_2)_m—OCOCR{=}CH_2 \quad (2)$$

When $R^1$ is a hydrocarbon group, it is preferably an alkyl group, an aralkyl group or an aryl group. The alkyl group may have a structure of straight chain, branched chain or ring. It may have a substituent on the ring structure portion of the aralkyl group or the aryl group. As a specific example, a benzyl group or a phenyl group is, for example, preferred. $R^1$ is preferably an alkyl group or a hydrogen atom.

When $Q^1$ is a bivalent organic group, it is preferably —$(CH_2)_p$—, —$CO(CH_2)_p$— or —$(CH_2)_pCO$—, wherein p is an integer of at least 1. $Q^1$ is preferably a single bond.

Specific examples of the (meth)acrylate having a polyoxyethylene group, will be given blow. In these examples, R represents a hydrogen atom or a methyl group.

$H(OCH_2CH_2)_3OCOCR{=}CH_2$.
$H(OCH_2CH_2)_9OCOCR{=}CH_2$.
$H(OCH_2CH_2)_{12}OCOCR{=}CH_2$.
$H(OCH_2CH_2)_{30}OCOCR{=}CH_2$.
$CH_3(OCH_2CH_2)_4OCOCR{=}CH_2$.
$CH_3(OCH_2CH_2)_8OCOCR{=}CH_2$.
$CH_3(OCH_2CH_2)_{10}OCOCR{=}CH_2$.
$CH_3CH_2(OCH_2CH_2)_9OCOCR{=}CH_2$.
$CH_3(CH_2)_3CH(C_2H_5)CH_2$—$(OCH_2CH_2)_8OCOCR{=}CH_2$.

The copolymer of the present invention may contain one type or more than one types of polymer units (b). When more than one types of polymer units (b) are contained, they are preferably (meth)acrylates having different total numbers of polyoxyethylene groups.

The polymer units (c) are polymer units of a (meth) acrylate having a polyoxypropylene group. This (meth) acrylate is a compound having a polyoxypropylene group at the alcohol residue of the (meth)acrylate, and the polyoxypropylene group may contain other oxyalkylene groups, so long as the hydrophilic nature is maintained.

The (meth)acrylate having a polyoxypropylene group, is preferably a compound of the following formula 3. In the formula 3, $R^3$ is a hydrogen atom or a $C_{1-30}$ hydrocarbon group. $Q^3$ is a single bond or a bivalent organic group. R is a hydrogen atom or a methyl group, and n is an integer of from 1 to 100, preferably an integer of from 3 to 30.

$$R^3—Q^3—(OCH(CH_3)CH_2)_n—OCOCR{=}CH_2 \quad (3)$$

When $R^3$ is a hydrocarbon group, it is preferably an alkyl group, an aralkyl group or an aryl group. The alkyl group may have any structure of straight chain, branched chain or ring. It may have a substituent on the ring structure of the aralkyl group or the aryl group. Specifically, a benzyl group or a phenyl group may, for example, be preferred. $R^3$ is preferably an alkyl group or a hydrogen atom.

When $Q^3$ is a bivalent organic group, it is preferably —$(CH_2)_p$— or —$CO(CH_2)_p$—, wherein p is an integer of at least 1. $Q^3$ is preferably a single bond.

Specific examples of the (meth)acrylate having a polyoxypropylene group will be given below. In these examples, $R^f$ represents a hydrogen atom or a methyl group.

$H(OCH(CH_3)CH_2)_9OCOCR{=}CH_2$.
$H(OCH(CH_3)CH_2)_{12}OCOCR{=}CH_2$.
$CH_3(OCH_2CH(CH_3))_8OCOCR{=}CH_2$.

The copolymer of the present invention may contain one type or more than one types of polymer units (c). When more than one types of polymer units (c) are contained, they are preferably (meth)acrylates having different total numbers of polyoxypropylene groups. By the presence of such hydrophobic polyoxypropylene groups, the copolymer containing such polymer units (c) has an antifouling property, particularly the durability of the antifouling property, improved as an antifouling agent, over a copolymer containing no such polymer units (c).

The polymer units (d) are polymer units of a (meth) acrylate having a blocked isocyanate group. This (meth) acrylate is a (meth)acrylate having at least one blocked isocyanate group, and it is preferably a compound obtained by blocking an isocyanate group of a (meth)acrylate having the isocyanate group, with a blocking agent.

The (meth)acrylate having an isocyanate group is preferably 2-isocyanate ethyl (meth)acrylate, or a reaction product obtained by reacting a (meth)acrylate having a functional group which can be bonded with an isocyanate group, with a polyisocyanate in such a ratio that at least one isocyanate group will remain.

The (meth)acrylate having a functional group which can be bonded to an isocyanate group, is preferably a (meth) acrylate having a hydroxyl group, particularly preferably a monoester of (meth)acrylic acid with a polyhydric alcohol. The polyhydric alcohol may, for example, be ethylene glycol, polyoxyethylene glycol, propylene glycol, polyoxypropylene glycol, glycerol, a trimethylolpropane-alkyleneoxide adduct or pentaerythritol.

The polyisocyanate may, for example, be an aromatic isocyanate such as 4,4'-diphenylmethane diisocyanate or tolylene diisocyanate, an aliphatic or alicyclinc isocyanate such as hexamethylene diisocyanate, isophorone diisocyanate, 4,4'-dicyclohexylmethane diisocyanate, cyclohexylene diisocyanate or norbornene diisocyanate, and their modification products such as isocyanurate modification products, prepolymer type modification products or biuret modification products. Particularly preferred are aliphatic and alicyclic isocyanates and their isocyanurate-modification products, prepolymer modification products or biuret modification products.

The blocking agent for an isocyanate group of an isocyanate group-containing (meth)acrylate may, for example, be preferably an alkyl ketoxime, a phenol, an alcohol, a β-diketone or a lactam, more preferably, methyl ethyl ketoxime, ε-caprolactam, phenol, cresol, acetyl acetone, diethyl malonate, isopropyl alcohol, t-butyl alcohol, or maleic acid imide, particularly preferably a blocking agent composed of a compound having a dissociation temperature of from 120 to 180° C., such as a dialkyl ketoxime such as methyl ethyl ketoxime, or a lactam such as ε-caprolactam.

Specific examples of the (meth)acrylate having a blocked isocyanate group include a compound having an isocyanate group of 2-isocyanate ethyl (meth)acrylate, blocked with methyl ethyl ketoxime, a compound having an isocyanate group of 2-isocyanate ethyl (meth)acrylate, blocked with ε-caprolactam, a compound having an isocyanate group of a 1:1 (molar ratio) reaction product of isophorone diisocyanate and 2-hydroxyethyl (meth)acrylate, blocked with methyl ethyl ketoxime, a compound having an isocyanate group of a 1:1 (molar ratio) reaction product of isophorone diisocyanate and 2-hydroxypropyl (meth)acrylate, blocked with methyl ethyl ketoxime, or a compound having an isocyanate group of a 1:1 (molar ratio) reaction product of norbornene diisocyanate and 2-hydroxyethyl (meth)acrylate, blocked with methyl ethyl ketoxime.

In the present invention, the polymer units (a) are polymer units each having a $R^f$ group, and they may have other groups. Further, the polymer units (d) are polymer units each having a blocked isocyanate group, and they may have additional groups other than the $R^f$ group. Further, the polymer units (b) are polymer units each having a polyoxyethylene group, and they may have additional groups other than the $R^f$ group and the blocked isocyanate group.

Further, the copolymer of the present invention may contain polymer units of other polymerizable monomers in addition to the above polymer units (a), (b), (c) and (d). By incorporating such polymer units of other polymerizable monomers, the durability of the water and oil repellency, the adhesive property of the copolymer to the substrate, the cross-linking property or the film-forming property, the flexibility and the antifouling property, may also be improved. As such other polymerizable monomers, the following examples may be given.

Ethylene, vinyl acetate, vinyl chloride, vinyl fluoride, a vinylidene halide, styrene, α-methylstyrene, β-methylstyrene, (meth)acrylamide, diacetone (meth) acrylamide, methylol-modified diacetone (meth)acrylamide, N-methylol (meth)acrylamide, a vinyl alkyl ether, a halogenated alkyl vinyl ether, a vinyl alkyl ketone, butadiene, isoprene, chloroprene, glycidyl (meth)acrylate, aziridinyl-ethyl (meth)acrylate, benzyl (meth)acrylate, aziridinyl (meth)acrylate, 2-hydroxyethyl (meth)acrylate, polycyloxane-containing (meth)acrylate, triallyl cyanurate, allylglydicyl ether, allyl acetate, N-vinylcarbazole, maleimide, N-methylmaleimide, (2-dimethylamino)ethyl (meth)acrylate, or 3-chloro-2-hydroxypropyl (meth) acrylate.

Particularly preferred is a crosslikable monomer such as N-methylol (meth)acrylamide, 2-hydroxyethyl (meth) acrylate, or 3-chloro-2-hydroxypropyl (meth)acrylate.

With respect to the proportions of the polymer units in the copolymer, it is preferred that the copolymer comprises from 20 to 80 parts by weight of the polymer units (a), from 10 to 50 part by weight of the polymer units (b), from 10 to 50 parts by weight of the polymer units (c) and from 0.1 to 30 parts by weight of the polymer units (d), per 100 parts by weight of the copolymer. Further, in a case where other polymerizable monomers are incorporated, they are incorporated preferably within a range of from 0.1 to 30 parts by weight.

When the polymer units (a) are from 20 to 80 parts by weight, the water and oil repellency upon application to clothings, will be adequate, the hydrophilic nature during washing will be sufficient, and a high antifouling property can be obtained. When the polymer units (b) are from 10 to 50 parts by weight, the hydrophilic nature during washing will be sufficient, a high antifouling property can be obtained, and durability in washing can be obtained, and it is further possible to obtain excellent color fastness. When the polymer units (c) are from 10 to 50 parts by weight, durability of the antifouling property will be high during washing or wearing of the clothings. When the polymer units (d) are from 0.1 to 30 parts by weight, the adhesive property to the substrate will be good, and high washing durability can be obtained, and such will present a good influence to the formation of a coating film, so that the performance of the antifouling composition will be improved.

As a method for synthesizing the copolymer of the present invention, a method may be employed which comprises copolymerizing a polymerizable monomer mixture comprising the (meth)acrylate having a $R^f$ group, the (meth)acrylate having a polyoxyethylene group, the (meth)acrylate having a polyoxypropylene group and the (meth)acrylate having a blocked isocyanate group, in the presence of a medium.

As a copolymerization method, a known or well known polymerization method such as bulk polymerization, suspension polymerization, emulsion polymerization, radiation polymerization, photopolymerization or solution polymerization, may, for example, be employed. For example, in the case of emulsion polymerization, a method may be employed wherein polymerizable monomers and an emulsifier are put into a medium comprising water, or a solvent mixture of water and a solvent, to emulsify the polymerizable monomers, followed by polymerization. Further, in the case of solution polymerization, a method may be employed wherein polymerizable monomers are dissolved and dispersed in a medium comprising a solvent, or a solvent mixture of water and a solvent, followed by polymerization.

The solvent to be used for the polymerization, may, for example, be an alcohol such as isopropyl alcohol or 2-butanol, a glycol such as propylene glycol or dipropylene glycol, a glycol ether such as dipropylene glycol monomethyl ether or ethylene glycol monomethyl ether, a ketone such as acetone, methyl ethyl ketone or methyl isobutyl ketone, an ester such as ethyl acetate or butyl acetate, a hydrocarbon solvent such as hexane, heptane, toluene, xylene or mineral turpentine, or a halogenated solvent such as a hydrofluorocarbon, a hydrochlorofluorocarbon or methylene chloride. As the polymerization initiating source, a polymerization initiator such as a peroxide, an azo compound or a persulfate, or ionized radiation rays such as γ-rays, may be employed. Further, a chain transfer agent may be employed to adjust the molecular weight.

As the chain transfer agent, a mercaptan such as n-dodecyl mercaptan, t-dodecyl mercaptan, stearyl mercaptan, 2-mercaptoethanol, 2-ethylhexyl thioglycolate, n-butyl thioglycolate, methoxybutyl thioglycolate or ethyl thioglycolate, or α-methylstyrene dimer, may, for example, be mentioned.

The molecular weight of the copolymer obtained by such a method for synthesis, is preferably from 1,000 to 1,000,000. The composition comprising the copolymer and the medium may be made to be an antifouling composition of the present invention, as it is, or by adjusting the concentration, as the case requires.

The antifouling composition of the present invention employs the above copolymer as an effective component, and it is usually a composition comprising the above copolymer and a medium. As the medium, water, a mixture of water with a solvent, or a solvent, is preferred. Particularly preferred is water, or a mixture of water with a solvent. The amount of the copolymer in the composition is preferably from 1 to 50 wt %, more preferably from 10 to 30 wt %. This concentration can optionally be changed depending upon the formulation at the time of use, or upon the intended condition. The antifouling composition of the present invention can be prepared by obtaining the copolymer and then formulating it into any optional form such as an emulsion, a suspension, a dispersion, a solution, an aerosol or a gel, in accordance with a conventional method.

Further, in addition to the above copolymer, other compounds may be incorporated to the antifouling composition of the present invention. As such other compounds, other water repellents or oil repellents, or other additives such as a polymer blend, a crosslinking agent, an insecticide, a flame retardant, an antistatic agent and an anticrease agent, may, for example, be mentioned. When such other compounds are incorporated, the amount thereof is preferably from 0.01 to 500 wt %, more preferably from 0.1 to 100 wt %, based on the above copolymer. Such other compounds may optionally be changed depending upon e.g. the purpose of treatment with the water and oil repellent or upon the substrate.

The antifouling composition of the present invention can be applied to a substrate by an optional method. For example, in a case where the antifouling composition of the present invention is an aqueous dispersion or a solvent solution, a method may be employed which comprises depositing it on the surface of a substrate by a conventional coating method such as dip coating, followed by drying. The drying may be carried out at room temperature or under heating. In the case of heating, the temperature is preferably from 40 to 200° C. Further, if necessary, curing may be carried out.

The treated product of the present invention is a treated product having a coating film formed on a substrate surface by applying the antifouling composition to the substrate surface, followed by drying.

The substrate to be treated by the antifouling agent of the present invention may, for example, be fibers, fiber woven fabrics, fiber knitted fabrics, glass, paper, wood, leathers, wools, asbestoes, bricks, cement, ceramics, metals, metal oxides, porcelains, or plastics. Fibers, fiber fabrics or fiber knitted fabrics are preferred. Examples of fibers include animal or plant natural fibers such as cotton, hemp, wool or silk, synthetic fibers such as polyamide, polyester, polyvinyl alcohol, polyacrylonitrile, polyvinyl chloride and polypropylene, semisynthetic fibers such as rayon and acetate, inorganic fibers such as glass fibers, and mixed fibers thereof.

The present invention will be described in further detail with reference to Examples. However, it should be understood that the present invention is by no means restricted by such specific Examples.

Examples 1 to 3 relate to Preparation Examples for (meth)acrylates having blocked isocyanate groups, and Examples 4 to 12 are Working Examples of the present invention and Examples 13 to 19 are Comparative Examples. The abbreviations used hereinafter, represent the compounds shown in Tables 1 and 2, respectively.

TABLE 1

| | |
|---|---|
| ABIP: | 2,2'-Azobis[2-(2-imidazolin-2-yl)propane] |
| BMA: | N-Butoxymethylacrylamide |
| CHPM: | 3-Chloro-2-hydroxypropyl methacrylate |
| CIE: | ε-Caprolactam adduct of 2-isocyanate ethyl methacrylate |
| EDM: | $CH_2{=}C(CH_3)CO(OCH_2CH_2)_9{-}{-}OCOC(CH_3){=}CH_2$ |
| EHM: | $H(OCH_2CH_2)_9OCOC(CH_3){=}CH_2$ |
| EOM: | $CH_3(OCH_2CH_2)_9OCOC(CH_3){=}CH_2$ |
| EOM23: | $CH_3(OCH_2CH_2)_{23}OCOC(CH_3){=}CH_2$ |
| EPM: | $H(OCH(CH_3)CH_2)_3{-}{-}(OCH_2CH_2)_2OCOC(CH_3){=}CH_2$ |
| FA: | $F(CF_2)_n(CH_2)_2OCOCH{=}CH_2$ (wherein n is an integer of from 6 to 16, and the average of n is 9.) |
| FA8: | $F(CF_2)_8(CH_2)_3OCOCH{=}CH_2$ |

TABLE 2

| | |
|---|---|
| HBA: | 4-Hydroxybutyl acrylate |
| HEA: | 2-Hydroxyethyl acrylate |
| HEMA: | 2-Hydroxyethyl methacrylate |
| IEMA: | 2-Isocyanate ethyl methacrylate |
| MA: | N-Methylol acrylamide |
| MEKX: | Methyl ethyl ketoxime |
| MIBK: | Methyl isobutyl ketone |
| MIE: | Methyl ethyl ketoxime adduct of 2-isocyanate ethyl methacrylate |
| MIP: | Methyl ethyl ketoxime adduct of a reaction product of 2-hydroxyethyl methacrylate with isophorone diisocyanate |
| PLM: | $H(OCH(CH_3)CH_2)_{12}OCOC(CH_3{=}CH_2$ |
| POM | $H(OCH(CH_3)CH_2)_9OCOC(CH_3){=}CH_2$ |

EXAMPLE 1

Into a four-necked glass flask equipped with a reflux condenser, a thermocouple thermometer and a stirrer, 155 g (1 mol) of IEMA and MIBK as a solvent, were charged, and the temperature was raised to 80° C. in dry nitrogen. Then, 87 g (1 mol) of MEKX was dropwise added thereto, and the reaction was carried out for 2 hours. Then, it was confirmed by IR that the absorption by the isocyanate group completely disappeared. By the above reaction, 242 g of MIE was obtained.

EXAMPLE 2

Into a four-necked glass flask equipped with a reflux condenser, a thermocouple thermometer and a stirrer, 155 g (1 mol) of IEMA and MIBK as a solvent, were charged, and the temperature was raised to 80° C. in dry nitrogen. Then, 113 g (1 mol) ε-caprolactam was dropwise added, and the reaction was carried out for 2 hours. Then, it was confirmed by IR that the absorption by the isocyanate group completely disappeared. By the above reaction, 268 g of CIE was obtained.

EXAMPLE 3

Into a four-necked glass flask equipped with a reflux condenser, a thermocouple thermometer and a stirrer, 130 g (1 mol) of HEMA was charged, and 222 g (1 mol) of isophorone diisocyanate was further added. The temperature was raised to 80° C. in dry nitrogen and maintained for 3 hours. After stirring for 1 hour, it was confirmed by titration that 50% of the isocyanate groups was consumed. Further, 87 g (1 mol) of MEKX was dropwise added thereto, and the reaction was carried out for 2 hours. Then, it was confirmed by IR that the absorption by the isocyanate group completely disappeared. By the above reaction, 439 g of MIP was obtained.

EXAMPLE 4

Into a 100 ml glass polymerization ampule, 8.00 g (40 parts by weight) of FA, 6.00 g (30 parts by weight) of EOM, 5.60 g (28 parts by weight) of POM, 0.40 g (2 parts by weight) of MIE, 0.20 g of ABIP, 0.20 g of methoxybutyl thioglycolate and 40.0 g of dipropylene glycol monomethyl ether, were added as polymerizable monomers, and they were polymerized at 75° C. for 18 hours while being shaked in a nitrogen atmosphere, to obtain a composition containing a copolymer. 18 Hours later, the crude reaction solution was analyzed by GC to confirm that no polymerizable monomers remained.

Water was added to the obtained composition containing the copolymer, to prepare a treating bath having the concentration of the copolymer adjusted to 0.8 wt %. As a cloth to be treated, a tropical cloth made of polyethylene terephthalate was prepared and immersed in the treating bath and then squeezed by a mangle to adjust the pick up to 80%. Then, the treated cloth was dried at 110° C. for 90 seconds and further subjected to heat treatment at 170° C. for 60 seconds. With respect to the obtained treated product, evaluation was carried out by the following methods. The results are shown in Table 3.

EXAMPLES 5 to 9

A composition containing a copolymer was obtained by polymerization in the same manner as in Example 4 except that the polymerizable compounds as identified in Table 3 were used in the amounts (part by weight) as identified in Table 3. Water was added to the obtained composition containing the copolymer to obtain a treating bath having the concentration of the copolymer adjusted to 0.8 wt %. Evaluation was carried out in the same manner as in Example 4. The results are shown in Table 3.

EXAMPLE 10

Into a 100 ml glass polymerization ampule, 8.40 g (42 parts by weight) of FA, 5.20 g (26 parts by weight) of EOM, 5.60 g (28 parts by weight) of POM, 0.40 g (2 parts by weight) of HEMA, 0.40 g (2 parts by weight) of MIE, 0.20 g of ABIP, 0.20 g of n-butyl thioglycolate and 40.0 g of ethylene glycol methyl isobutyl ether, were added as polymerizable monomers, and a composition containing a copolymer, was obtained in the same manner as in Example 4. Water was added to the obtained composition containing the copolymer to obtain a treating bath having the concentration of the copolymer adjusted to 0.8 wt %. Evaluation was carried out in the same manner as in Example 4. The results are shown in Table 3.

EXAMPLE 11

Into a 100 ml glass polymerization ampule, 8.00 g (40 parts by weight) of FA8, 5.60 g (28 parts by weight) of EOM, 5.00 g (24 parts by weight) of POM, 0.40 g (2 parts by weight) of HEA, 0.20 g (1 part by weight) of EDM, 1.00 g (5 parts by weight) of MIE, 0.20 g of ABIP, 0.20 g of ethyl thioglycolate and 40.0 g of MIBK, were added as polymerizable monomers, and a composition containing a copolymer, was obtained in the same manner as in Example 4. After distilling MIBK off under reduced pressure from the obtained composition containing the copolymer, water was added thereto to obtain a treating bath having the concentration of the copolymer adjusted to 0.8 wt %. Evaluation was carried out in the same manner as in Example 4. The results are shown in Table 3.

EXAMPLE 12

Into a 100 ml glass polymerization ampule, 8.00 g (40 parts by weight) of FA8, 5.60 g (28 parts by weight) of EOM, 5.00 g (25 parts by weight) of POM, 0.40 g (2 parts by weight) of HBA, 0.20 g (1 part by weight) of MA, 0.20 g (1 part by weight) of BMA, 0.20 g (1 part by weight) of CHPM, 0.40 g (2 parts by weight) of MIE, 0.20 g of ABIP, 0.20 g of 2-ethylhexyl thioglycolate and 40.0 g of acetone, were added as polymerizable monomers, and a composition containing a copolymer was obtained in the same manner as in Example 4. After distilling off acetone from the obtained composition containing the copolymer, water was added to prepare a treating bath having the concentration of the copolymer adjusted to 0.8 wt %. Evaluation was carried out in the same manner as in Example 4. The results are shown in Table 3.

EXAMPLES 13 to 17

A composition containing a copolymer was obtained by polymerization in the same manner as in Example 4 except that the polymerizable compounds as identified in Table 4 were used in the amounts (parts by weight) as identified in Table 4. Water was added to the obtained composition containing the copolymer to prepare a treating bath having the concentration of the copolymer adjusted to 0.8 wt %. Evaluation was carried out in the same manner as in Example 4. The results are shown in Table 4.

EXAMPLE 18

Water, melamine and an amine type catalyst were added to the composition containing the copolymer, obtained in Example 15, to prepare a treating bath having the concentration of the copolymer adjusted to 0.8 wt %, the concentration of melamine to 0.3 wt % and the concentration of the amine type catalyst to 0.1 wt %. Evaluation was carried out in the same manner as in Example 4. The results are shown in Table 4.

EXAMPLE 19

Water and an emulsion of MEKX blocked product of diphenylmethane diisocyanate, were added to the composition containing the copolymer, obtained in Example 15, to prepare a treating bath having the concentration of the copolymer adjusted to 0.8 wt % and the concentration of the MEKX blocked product of diphenylmethane diisocyanate to 0.5 wt %. Evaluation was carried out in the same manner as in Example 4. The results are shown in Table 4.

Method for Evaluation of Oil Repellency

Evaluation was carried out in accordance with AATCC-TM118, and the results were represented by oil repellency grades as identified in Table 5. The higher the oil repellency grade, the higher the performance. Symbol +(−) for the oil repellency grade indicates that the performance in question is slightly better (poor).

Method for Evaluation of SR Property (soil removal property)

Evaluation was carried out by the following method, and the results were represented by the SR property grades as identified in Table 6. Symbol +(−) for the SR property grade indicates that the performance in question is slightly better (poor).

(1) A test cloth was spread on a blotting paper placed horizontally, and five drops of soiled motor oil were dropped. A polyethylene sheet was put thereon, and a weight of 2 kg was placed thereon. 60 seconds later, the weight and the polyethylene sheet were removed.

(2) Excess motor oil was wiped off, and the test cloth was left to stand at room temperature for 60 minutes.

(3) A ballast cloth was added to the test cloth to bring the weight to 1 kg, followed by washing by an electric washing machine using 30 g of a detergent (Attack New Compact Type, tradename, manufactured by Kao Corporation) with a bath volume of 45 liter at 40° C. for 10 minutes, rinsing and drying in air.

(4) The degree of removal of the motor oil was visually evaluated in accordance with Table 6.

Further, for the test on durability of the treated cloth, the same washing as in the evaluation for the SR property, was repeated 20 times, followed by drying in air. After washing, evaluation was carried out with respect to the test cloth.

With respect to yellowing, randomly selected 15 persons visually compared the color of a polyethylene terephthalate tropical cloth before the treatment and the color after the treatment, whereby the presence or absence of a change was judged. The evaluation by the majority was adopted. With respect to the texture, the presence or absence of hardening of the texture was evaluated in accordance with Evaluation Procedure 5 of AATCC (1992).

Method for Evaluation of Color Fastness

Evaluation was carried out in accordance with JIS L-0849-1996, and the results were represented by the pollution grades as identified in Table 7. The higher the grade, the better the color fastness against abrasion. As a test piece, a polyester doeskin cloth (black color) was used, and as the abrasion testing machine, GAKUSHINGATA was used. Further, the dry test and the wet test were carried out.

TABLE 3

| | Examples | | | | | | | | |
|---|---|---|---|---|---|---|---|---|---|
| | 4 | 5 | 6 | 7 | 8 | 9 | 10 | 11 | 12 |
| FA | 40 | 40 | 40 | 40 | 35 | 43 | 42 | | |
| FA8 | | | | | | | | 40 | 40 |
| EOM | 30 | 35 | 25 | 30 | | | | 28 | 28 |
| EOM23 | | | | | | | 26 | | |
| EHM | | | | | 30 | 30 | | | |
| POM | 28 | 23 | 33 | | | 25 | 28 | 24 | 25 |
| PLM | | | | 28 | 33 | | | | |
| HEMA | | | | | | | 2 | | |
| HEA | | | | | | | | 2 | |
| EDM | | | | | | | | 1 | |
| HBA | | | | | | | | | 2 |
| BMA | | | | | | | | | 1 |
| CHPM | | | | | | | | | 1 |
| MA | | | | | | | | | 1 |
| MIE | 2 | | | | 2 | | 2 | 5 | 2 |
| CIE | | 2 | | 2 | | | | | |
| MIP | | | 2 | | | 2 | | | |
| Oil repellency before washing | 7 | 7 | 7 | 7 | 7 | 7 | 7 | 7− | 7− |
| Oil repellency after washing | 6 | 6 | 6− | 6 | 6 | 6 | 6 | 6 | 6 |
| SR property before washing | 5 | 5 | 5 | 5 | 5 | 5 | 5 | 5 | 5 |
| SR property after washing | 4+ | 4+ | 4− | 4 | 4 | 4− | 4+ | 4 | 4+ |
| Yellowing | Nil | Nil | Nil | Nil | Nil | Nil | Nil | Nil | Nil |
| Hardening of texture | Nil | Nil | Nil | Nil | Nil | Nil | Nil | Nil | Nil |
| Color fastness | | | | | | | | | |
| (Dry test) | 4–5 | 4–5 | 4–5 | 4–5 | 4–5 | 4–5 | 4–5 | 4–5 | 4–5 |
| (Wet test) | 4 | 4 | 4 | 4 | 4 | 4 | 4 | 4 | 4 |

TABLE 4

| | Examples | | | | | | |
|---|---|---|---|---|---|---|---|
| | 13 | 14 | 15 | 16 | 17 | 18 | 19 |
| FA | 40 | 40 | 40 | | 40 | 40 | 40 |
| EOM | 58 | | | 30 | | | |
| EHM | | | 25 | | | 25 | 25 |
| POM | | 58 | 35 | | | 35 | 35 |
| PLM | | | | 68 | | | |
| EPM | | | | | 58 | | |
| MIE | 2 | | | | 2 | | |
| CIE | | 2 | | | | | |
| MIP | | | | 2 | | | |
| Oil repellency before washing | 2+ | 3 | 4+ | 0 | 4 | 5 | 5 |
| Oil repellency after washing | 0 | 0 | 0 | 0 | 1 | 3+ | 4 |
| SR property | 3 | 2 | 4− | 1 | 3 | 4 | 4 |

TABLE 4-continued

| | Examples | | | | | | |
|---|---|---|---|---|---|---|---|
| | 13 | 14 | 15 | 16 | 17 | 18 | 19 |
| before washing | | | | | | | |
| SR property | 1 | 1 | 1 | 1 | 1 | 3 | 3+ |
| after washing | | | | | | | |
| Yellowing | Nil | Nil | Nil | Nil | Nil | Nil | Observed |
| Hardening of texture | Nil | Nil | Nil | Nil | Nil | Observed | Observed |
| Color fastness | | | | | | | |
| (Dry test) | 3 | 3 | 3 | 3 | 3 | 3 | 3 |
| (Wet test) | 2 | 1–2 | 2 | 2 | 1–2 | 2 | 2 |

TABLE 5

| Oil repellency grade | Test liquid | Surface tension of test liquid (dyn/cm) (25° C.) |
|---|---|---|
| 8 | n-Heptane | 20.0 |
| 7 | n-Octane | 21.8 |
| 6 | n-Decane | 23.5 |
| 5 | n-Dodecane | 25.0 |
| 4 | n-tetradecane | 26.7 |
| 3 | n-Hexadecane | 27.3 |
| 2 | 65 parts of nujoule/ 35 parts of hexadecane | 29.6 |
| 1 | Nujoule | 31.2 |
| 0 | Less than 1 | |

TABLE 6

| SR property grades | Evaluation standards |
|---|---|
| 5 | The stain was completely removed. |
| 4 | The stain was not completely removed and slightly remained. |
| 3 | The profile of the stain was vague, but the degree of removal was low. |
| 2 | The profile of the stain was clear. |
| 1 | The stain was not substantially removed. |

TABLE 7

| Pollution grades | Evaluation standards |
|---|---|
| 5 | Pollution was at a level of pollution gray scale No. 5. |
| 4–5 | Pollution was at a level of pollution gray scale No. 4–5. |
| 4 | Pollution was at a level of pollution gray scale No. 4. |
| 3–4 | Pollution was at a level of pollution gray scale No. 3–4. |
| 3 | Pollution was at a level of pollution gray scale No. 3. |
| 2–3 | Pollution was at a level of pollution gray scale No. 2–3. |
| 2 | Pollution was at a level of pollution gray scale No. 2. |
| 1–2 | Pollution was at a level of pollution gray scale No. 1–2. |
| 1 | Pollution was at a level of pollution gray scale No. 1 or more. |

The antifouling composition of the present invention presents an antifouling property which has durability improved over the conventional compositions. Further, a cloth treated with the composition has a merit such that it is free from yellowing or from hardening of the texture. Further, there is a merit that excellent color fastness can thereby be obtained.

What is claimed is:

1. An antifouling composition comprising, as an effective component, a copolymer comprising the following polymer units (a), (b), (c) and (d):

(a) a polymer unit of a (meth)acrylate having a polyfluoroalkyl group, (b) a polymer unit of a (meth)acrylate having a polyoxyethylene group, (c) a polymer unit of a (meth)acrylate having a polyoxypropylene group, and (d) a polymer unit of a (meth)acrylate having a blocked isocyanate group;

wherein said polyflouroalkyl group is represented by formula (1)

$$R^f—Q—OCOCR=CH_2 \quad (1);$$

wherein $R^f=C_nF_{2n+1}$, and n=1–20

Q is a $—(CH_2)_pCON(CH_2)_q—$ group, a $—(CH_2)_pNHCO(CH_2)_q—$ group, a $—(CH_2)_pOCO—NH—(CH_2)_q—$ group, a $—(CH_2)_pNH—OCO—(CH_2)_p—$ group, a $—(CH_2)_pNR^1SO_2(CH_2)_q—$ group, a $—(CH_2)_pNHCO—NH—(CH_2)_q—$ group, or a $—(CH_2)_pCH(OH)—(CH_2)_p—$ group; and $R^1$=H, or $C_nH_{2n+1}$, p and q>0, p+q=from 1 to 22, and R=H, or methyl.

2. The antifouling composition according to claim 1, wherein the polymer unit (d) is a (meth)acrylate having an isocyanate group blocked with methyl ethyl ketoxime or ϵ-caprolactam.

3. The antifouling composition according to claim 2, wherein the polymer unit (d) is a 2-isocyanate ethyl (meth) acrylate having a blocked isocyanate group.

4. The antifouling composition according to claim 3, wherein $R^f=C_nF_{2n+1}$, with n=6–16.

5. The antifouling composition according to claim 2, wherein the polymer unit (d) is obtained by reacting a (meth)acrylate having a hydroxyl group with a polyisocyanate in such a ratio that at least one isocyanate group will remain.

6. The antifouling composition according to claim 5, wherein $R^f=C_nF_{2n+1}$, with n=6–16.

7. The antifouling composition according to claim 2, wherein $R^f=C_nF_{2n+1}$, with n=6–16.

8. The antifouling composition according to claim 1, wherein the polymer unit (d) is a 2-isocyanate ethyl (meth) acrylate having a blocked isocyanate group.

9. The antifouling composition according to claim 8, wherein $R^f=C_nF_{2n+1}$, with n=6–16.

10. The antifouling composition according to claim 1, wherein the polymer unit (d) is obtained by reacting a (meth)acrylate having a hydroxyl group with a polyisocyanate in such a ratio that at least one isocyanate group will remain.

11. The antifouling composition according to claim 1, wherein $R^f=C_nF_{2n+1}$, with n=6–16.

12. The antifouling composition according to claim 1, wherein the copolymer comprises from 20 to 80 parts by weight of the polymer unit (a), from 10 to 50 parts by weight of the polymer unit (b), from 10 to 50 parts by weight of the polymer unit (c) and from 0.1 to 30 parts by weight of the polymer unit (d), per 100 parts by weight of the copolymer.

13. An antifouling composition comprising an aqueous medium and the copolymer according to claim 1, as an effective component, dispersed in the aqueous medium.

14. A method for producing an antifouling composition, which comprises copolymerizing a polymerizable monomer mixture comprising (a) a (meth)acrylate having a polyfluoroalkyl group, (b) a (meth)acrylate having a polyoxyethylene group, (c) a (meth) acrylate having a polyoxypropylene group and (d) a (meth)acrylate having a blocked isocyanate group, in the presence of a medium, wherein said polyflouroalkyl group is represented by formula (1)

$$R^f—Q—OCOCR=CH_2 \quad (1);$$

wherein $R^f=C_nF_{2n+1}$, and n=1–20

Q is a $—(CH_2)_pCON(CH_2)_q—$ group,
a $—(CH_2)_pNHCO(CH_2)_q—$ group,
a $—(CH_2)_pOCO—NH—(CH_2)_q—$ group,
a $—(CH_2)_pNH—OCO—(CH_2)_q—$ group,
a $—(CH_2)_pNR^1SO_2(CH_2)_q—$ group,
a $—(CH_2)_pNHCO—NH—(CH_2)_q—$ group, or
a $—(CH_2)_pCH(OH)—(CH_2)_q—$ group; and $R^1$=H, or $C_nH_{2n+1}$, p and q>0, p+q=from 1 to 22, and R=H, or methyl.

* * * * *